US005333759A

United States Patent [19]

Deering

[11] Patent Number: 5,333,759

[45] Date of Patent: Aug. 2, 1994

[54] MODULAR DISPENSING TOWER

[75] Inventor: Robert S. Deering, San Antonio, Tex.

[73] Assignee: Lancer Corporation, San Antonio, Tex.

[21] Appl. No.: 4,529

[22] Filed: Jan. 14, 1993

[51] Int. Cl.[5] ..... B67D 5/56

[52] U.S. Cl. ..... 222/129.1; 222/146.6; 222/424

[58] Field of Search ..... 222/196.6, 129.1–129.4, 222/424, 318

[56] References Cited

U.S. PATENT DOCUMENTS

| | | | |
|---|---|---|---|
| 3,331,536 | 7/1967 | De Lorenzo | 222/129.1 X |
| 4,687,120 | 8/1987 | McMillin | 222/129.1 X |
| 4,808,346 | 2/1989 | Strenger | 222/129.1 X |
| 4,969,576 | 11/1990 | Merrill et al. | 222/129.1 X |
| 4,979,639 | 12/1990 | Hoover et al. | 222/129.1 X |
| 5,086,951 | 2/1992 | Nakayama et al. | 222/129.1 |
| 5,228,312 | 7/1993 | Williams | 222/129.1 X |
| 5,249,710 | 10/1993 | Hassell et al. | 222/129.1 X |

*Primary Examiner*—Andres Kashnikow
*Assistant Examiner*—Kenneth DeRosa
*Attorney, Agent, or Firm*—Donald R. Comuzzi; Christopher L. Makay

[57] ABSTRACT

The present invention is a beverage dispensing apparatus which allows the dispensing of beverages from a modular dispensing tower which may be positioned remote from both the product and the cooling unit. The modular dispensing tower is connected to the cooling unit through an insulated trunk line which allows its positioning up to twenty five feet away from the cooling unit. Additionally, the modular dispensing tower comprises an insulated manifold which operates to significantly decrease the temperature of the dispensed "casual" drink. The manifold houses a plurality of product conduits which are positioned against a carbonated water conduit which works in a recirculation system to greatly reduce the temperature of the dispensed "casual" drink. Furthermore, the modular dispensing tower may reside on the countertop or may be mounted onto the edge of the countertop in order to save countertop space. Also to save countertop space, the cooling unit and product source is configured to fit underneath a counter with only the modular dispensing tower residing on the counter or mounted onto an edge. The present invention therefore greatly saves countertop space while providing a modular dispensing tower configuration which greatly reduces the temperature of the dispensed "casual" drink.

15 Claims, 3 Drawing Sheets

MODULAR DISPENSING TOWER

BACKGROUND OF THE INVENTION

The present invention relates to an apparatus for dispensing drinks and, more particularly, but not by way of limitation, to an apparatus for dispensing drinks which is remote from the cooling unit.

A major concern in the drink dispensing industry is the availability of countertop space. Available countertop space is of particular concern to small convenience stores, cafeterias, concession stands, fast food service lines, or like businesses because rents which are normally determined based upon total square footage are expensive. Thus, available countertop space becomes an extremely valuable commodity to those in the above businesses. That is, wasted countertop space can be directly equated to higher overhead for a business.

Conventional drink dispensers are typically single units comprising a housing that contains a carbonator coupled to a cooling apparatus (i.e., either a refrigeration unit including product lines or a cold plate), which in turn is coupled to drink dispensing valves connected to the outside of the housing. Additionally, the carbonator is connected to a water source and $CO_2$ source while the cooling apparatus is coupled to a product source.

The major disadvantage of such units is that they are bulky and occupy large amounts of countertop space. If the units were smaller or placed in a different location, available countertop space could be increased, thereby, allowing for more effective countertop utilization. The drink dispensing industry, therefore, requires a drink dispensing unit which will fit under a counter with only a minimum of dispensing equipment occupying countertop space.

Another concern in the drink dispensing industry is the temperature at which drink dispensing systems dispense the "casual" drink (i.e., the temperature of the drink dispensed during periods of low use or the temperature of the drink dispensed after no drink has been dispensed for an extended period). It is desirable to dispense drinks below a temperature of 40° F. A drink dispensed above 40° F. will foam excessively which makes the dispensing of a drink difficult if not impossible. Unfortunately, conventional drink dispensers typically are unable to dispense the "casual" drink at a temperature below 40° F. and normally dispense the "casual" drink with an average temperature of 42° F. Such a dispensing temperature for the "casual" drink is unacceptable in the drink dispensing industry, and therefore, there is a large demand in that industry for a drink dispensing system which can deliver a colder "casual" drink.

The present invention, accordingly, answers industry demand and overcomes the above problems by dispensing the "casual" drink below 40° F. while occupying minimal countertop space because except for a modular dispensing tower, the entire unit can be configured to reside underneath a counter.

SUMMARY OF THE INVENTION

The present invention is a beverage dispensing apparatus which can be configured to function as a conventional countertop beverage dispensing unit, or, more importantly, the present invention can be converted from a conventional countertop unit to an under the counter beverage dispensing apparatus having a modular dispensing tower which is remote from the cooling unit, thus, saving significant countertop space. Furthermore, the design of the modular dispensing tower is such that the beverage dispenser of the present invention will dispense the "casual" drink at a temperature below 40° F. The beverage dispensing apparatus of the present invention, therefore, while in its under the counter configuration saves large amounts of countertop space while still ensuring that the "casual" drink will be dispensed at a temperature below 40° F.

The beverage dispensing apparatus of the present invention comprises a cooling chamber and a cooling chamber cover which function together to house the cooling unit and a recirculation unit. The cooling chamber-cooling chamber cover combination further functions to house a water line, product lines, and a carbonator. The cooling unit comprises a refrigeration unit which forms an ice bank from a cooling fluid, typically water, contained within the cooling chamber. The ice bank provides the cooling required by the water lines, product lines, and the recirculation line of the recirculation unit. The product lines communicate at their inlets with a product source and at their outlets with dispensing valves mounted on the modular dispensing tower. The water line connects at its inlet to a water source and at its outlet to the carbonator. The carbonator is further connected to a $CO_2$ source and inlets both water and $CO_2$ to form carbonated water which is dispensed, along with the product, from the dispensing valves mounted on the modular dispensing tower, thus, forming the carbonated beverage product.

The recirculation unit comprises a recirculation coil positioned within the cooling chamber and connected at its outlet using a tee connection to the carbonated water line which in turn is connected to the dispensing valves mounted on the modular dispensing tower. The inlet of the recirculation coil is also connected to the modular dispensing tower by a carbonated water return line. Thus, the carbonated water continually circulates from the modular dispensing tower through the recirculation coil and back to the modular dispensing tower when the dispensing valves are not actuated. The recirculation unit further comprises a pump interposed to the modular dispensing tower and the recirculation coil to continually pump the carbonated water through the recirculation coil when the dispensing valves are not actuated. Additionally, when the dispensing valves are actuated, carbonated water from the carbonator will be introduced into the modular dispensing tower so that sufficient carbonated water to form a carbonated beverage will always be present.

In the under the counter configuration, the modular dispensing tower is remote from the cooling unit and may be positioned up to twenty five feet away. Connection between the modular dispensing tower and the cooling unit, namely the carbonated water/recirculation line, the recirculation return line, and the product lines, is effected through a trunk line which removably connects at one end to the above lines and at its opposite end to a manifold housed within the modular dispensing tower. In turn, the manifold is connected to the dispensing valves mounted on the modular dispensing tower. The manifold comprises a plurality of conduits encased in insulation which prevents heat exchange between both the carbonated water and product and the environment. The trunk line itself is insulated to further help prevent the heat exchange between both the carbonated water and product and the environment.

The beverage dispensing apparatus of the present invention dispenses the "casual" drink below 40° F. as a result of the recirculation of the carbonated and the unique configuration of the insulated manifold. That is, by recirculating the carbonated water from the modular dispensing tower back to the cooling unit during periods of non-use, the carbonated water is ensured of being at the lowest temperature possible (i.e., approximately 34° F.). Accordingly, a dispensed drink will have extremely cold carbonated water. Furthermore, the manifold is configured such that the product conduits physically contact the carbonated water conduit. Thus, because the carbonated water conduit is significantly cooler than the product conduits, heat exchange between them takes place. Although the carbonated water accumulates heat, the amount of heat gathered is insufficient to raise the temperature of the carbonated water above 40° F. while the heat lost by the product lines is sufficient to lower the product temperature below 40° F. The beverage dispensing apparatus of the present invention, therefore, dispenses the "casual" drink at or below 38° F.

Furthermore, the design of the modular dispensing tower remote from the cooling unit saves countertop space because the modular dispensing tower placed on the countertop by itself is considerably smaller than conventional beverage dispensing units which have the cooling unit mounted on the countertop. In addition, the modular dispensing tower is provided with a mount which permits it be fastened to the edge of a countertop, thereby, taking up even less space than conventional beverage dispensing units.

It is, therefore, an object of the present invention to provide a beverage dispensing apparatus with a cooling unit capable of fluidly communicating with a remote modular dispensing tower.

It is another object of the present invention to provide a beverage dispensing apparatus which is capable of dispensing a "casual" drink at a temperature below 40° F.

It is a further object of the present invention to provide a beverage dispensing apparatus which continually circulates carbonated water through the cooling unit and modular dispensing tower in order to reduce the temperature of the dispensed "casual" drink.

It is still another object of the present invention to provide a beverage dispensing apparatus with a modular dispensing tower having an insulated manifold which reduces the heat exchange between the previously cooled product and carbonated water and the environment.

It is still a further object of the present invention to provide a beverage dispensing apparatus with a modular dispensing tower having an insulated manifold which contacts the product lines with the carbonated beverage lines having recirculated carbonated water therein in order to facilitate heat exchange therebetween.

Still other features and advantages of the present invention will become evident to those skilled in the art in light of the following.

DETAILED DESCRIPTION OF THE PREFERRED EMBODIMENT

Figure 1:
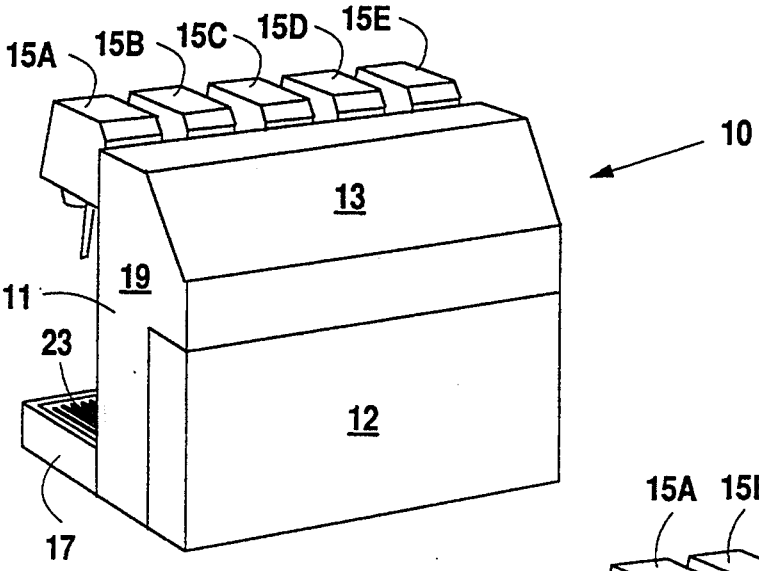
FIG. 1 is a perspective view showing the rear of the modular dispensing tower of the present invention in the configuration used when it resides on a planar surface.

Referring to the FIGS., the modular dispensing tower according to the preferred embodiment of the present invention will be described. Modular dispensing tower 10 comprises housing 11, top cover 13, manifold 14, face plate 16 (see FIGS. 6 and 7), dispensing valves 15A–E and drip tray 17. Housing 11 comprises side walls 18 and 19 which are parallel to each other and connected by wall 20. Housing 11 encloses and supports manifold 14. Manifold 14 is placed within housing 11 and secured to the housing using screws 21 and 22 (see FIG. 3). Face plate 16 (see FIGS. 6 or 7) is then fitted to the front of housing 11 and secured using any suitable means such as screws. Face plate 16 is provided with openings at its top (not shown) which permit the connection of the dispensing valves to the conduits housed within manifold 14 (described herein with reference to FIGS. 4 and 5). Furthermore, face plate 16 supports dispensing valves 15A–E which are mounted onto face plate 16 using any suitable means such as screws or nuts and bolts. After dispensing valves 15A–E are attached to manifold 14 and mounted onto face plate 16, top cover 13 is mounted over housing 11 using any suitable means such as screws in order to remove manifold 14 and the backs of dispensing valves 15A–E from view. Positioned below dispensing valves 15A–E and connected to the bottom of face plate 16 using any conventional means such as screws is drip tray 17 which collects spilled product and ice. Drip tray 17 is connected to a drain using a hose (not shown) to conduct the spilled product and melted ice to the drain. Additionally, positioned within drip tray 17 is cup rest 23 which provides a support for cups as they are filled from any one of dispensing valves 15A–E.

Figure 6:
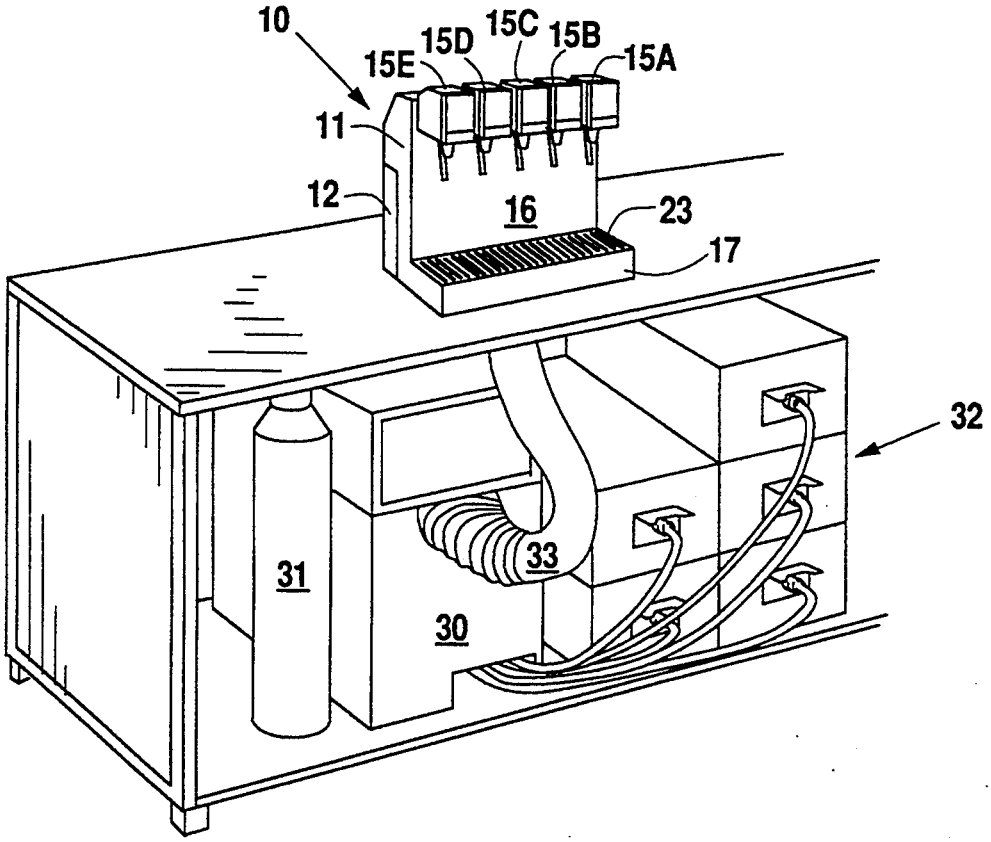
FIG. 6 is a perspective view showing the beverage dispensing apparatus of the present invention wherein the modular dispensing tower resides on top of a counter while the cooling unit, product source, and $CO_2$ source fit under the counter.
Figure 7:
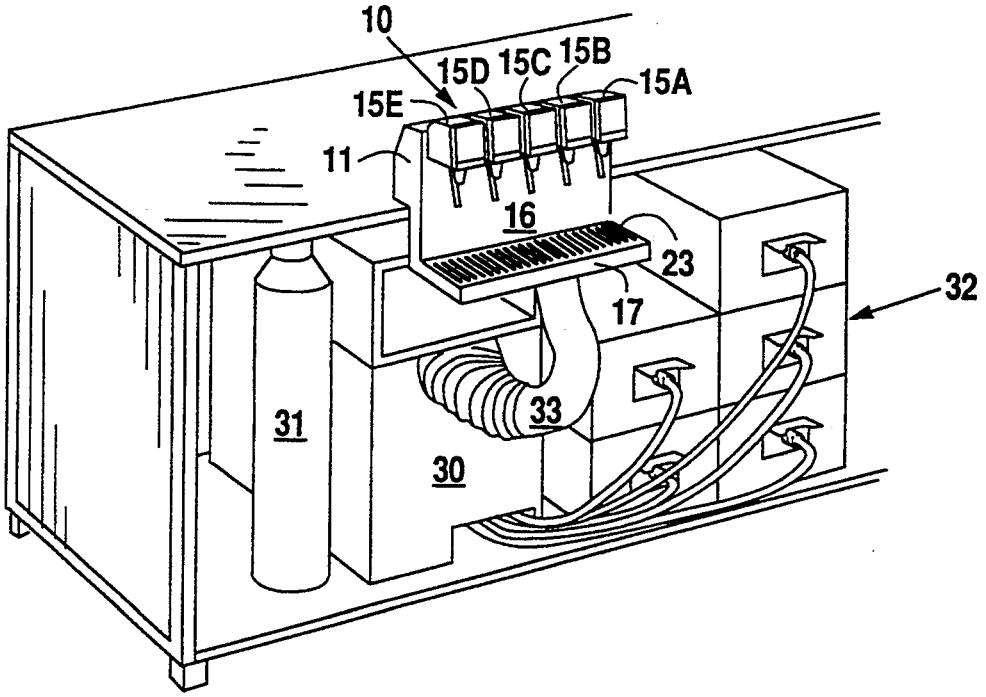
FIG. 7 is a perspective view showing the beverage dispensing apparatus of the present invention wherein the modular dispensing tower is mounted onto the front of a countertop while the cooling unit, product source, and $CO_2$ source fit below the counter.

Modular dispensing tower 10 may be mounted onto a countertop such that it resides completely on the counter (See FIG. 6) or it may be mounted onto one of the edges of the counter (See FIG. 7). To allow mounting of modular dispensing tower 10 onto the edge of a counter, the back of wall 20 is provided with bracket 24. Bracket 24 is mounted onto the back of the wall 20 using any suitable means such as screws or welding. Bracket 24 is fitted with fastening screws 25 and 26 which facilitate the mounting of modular dispensing tower 10 onto the edge of a countertop (described herein). In the event that modular dispensing tower 10 is configured to reside on top of the counter, it is provided with rear cover 12 which mounts to the back of housing 11 using any suitable means such as screws in order to cover bracket 24 and provide an aesthetically pleasing appearance.

Figure 3:
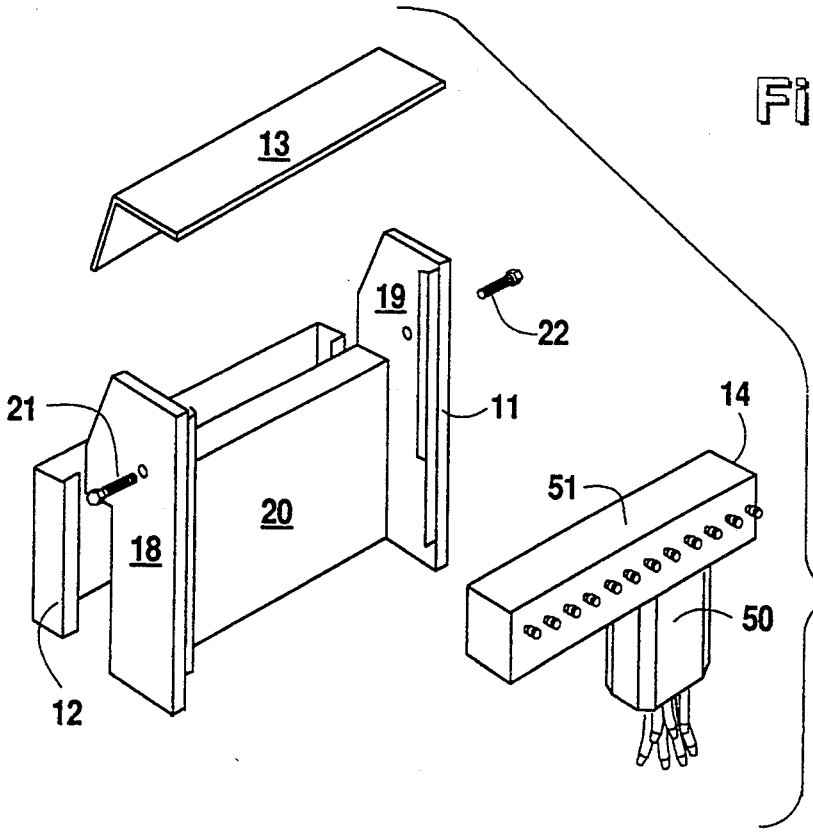
FIG. 3 is an exploded perspective view showing the front of the modular dispensing tower of the present invention.
Figure 4:
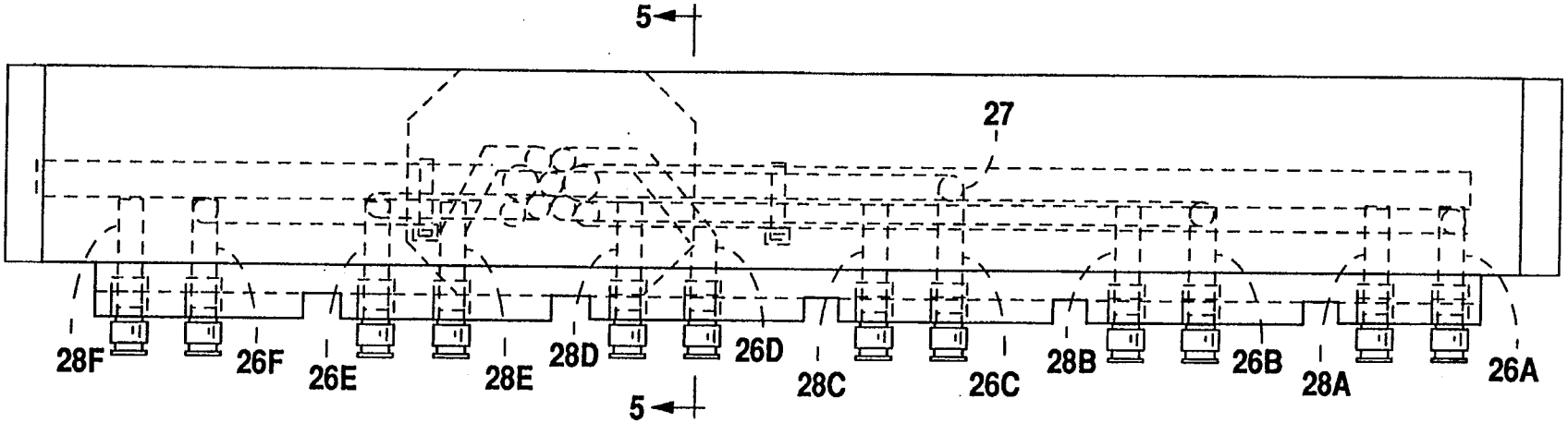
FIG. 4 is a top view of the manifold of the present invention showing the positioning of the fluid conduits within the manifold.
Figure 5:
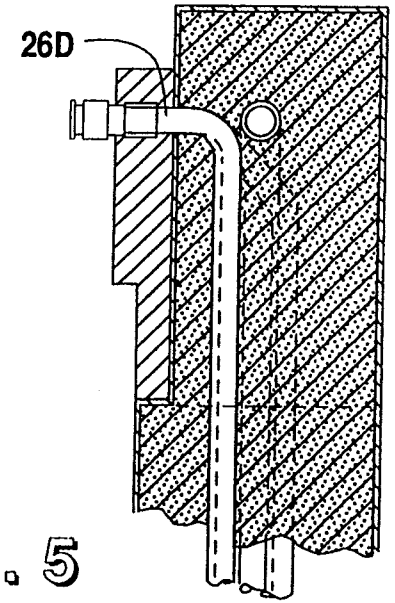
FIG. 5 is cross-sectional partial top view showing the manifold of the present invention.

Turning specifically to FIGS. 3–5, manifold 14 of the present invention will be described. Manifold 14 comprises product conduits 26A–F and carbonated water conduit 27 all of which are encapsulated in an insulating material such as foam. The inlets of product conduits 26A–F extend slightly beyond the lower portion of the insulating material and are provided with barbs which facilitate the connection of product conduits 26A–F to other product lines (described herein) which ultimately connect to a product source. Each outlet of product conduits 26A–F connects to one of dispensing valves 15A–E using any suitable means such as a threaded cap. Carbonated water conduit 27 also extends below the lower portion of the insulating material and has an inlet having a barb which facilitates connection to a carbonated water line which in turn is connected to a carbonator. Carbonated water conduit 27 delivers carbonated water to dispensing valves 15A–E through outlets 28A–F one of which is connected to each of dispensing valves 15A–E using any suitable means such as threaded caps. However, unlike product lines 26A–F, carbonated water conduit 27 does not terminate at outlets 28A–F, but instead, circles around to form a return line which also extends below the insulating material of manifold 14. The return line portion of carbonated water conduit 27 connects to the input of a recirculation coil housed within a cooling unit and permits recirculation of the carbonated water, thus, providing increased and constant cooling of the carbonated water. The inlet of carbonated water conduit 27 is not only connected to a carbonator through a carbonated water line but also to the outlet of the recirculation coil. The carbonator and the outlet of the recirculation coil are connected to the carbonated water line through a T-shaped connection. Thus, the constant recirculation of the carbonated water helps to decrease the temperature at which the "casual" drink is dispensed.

Carbonated water conduit 27 is configured within the insulating material such that it encircles product conduits 26A–F and contacts those conduits both in inlet stem portion 50 and outlet head portion 51 of the insulating foam material which encapsulates product conduits 26A–F and carbonated water conduit 27 and forms manifold 14 (see FIG. 3). The contact between product conduits 26A–F and carbonated water conduit 27 permits a heat exchange between the product carried through product conduits 26A–F and the carbonated water carried through carbonated water conduit 27 which facilitates a dispensing temperature of the carbonated beverage. That heat exchange occurs because the carbonated water is maintained at a temperature below that of the product due to its constant recirculation (approximately 34° F.). The carbonated water circulating through manifold 14 removes heat from the product and takes it back to the recirculation coil where it is removed before returning via the carbonated water line in the heat exchange which takes place in the cooling unit. Thus, as the carbonated water circulates, the continual heat exchange between the carbonated water and the product keep the product at a temperature below 40° F. while the carbonated water still remains at a temperature below 40° F. Additionally, the insulating material utilized to construct manifold 14 significantly reduces the heat exchange between both product conduits 26A–F and carbonated water conduits 27 and the atmosphere. The reduction in the loss of cooling to the atmosphere is directly reflected in a reduced dispensed drink temperature, specifically, the temperature of the "casual" drink. Thus, the beverage dispensing apparatus of the present invention while using modular dispensing tower 10 will dispense a "casual" drink at a temperature of approximately 38° F. because the recirculation of cooled carbonated water through the highly insulated manifold reduces product temperature, thus, allowing drinks to be dispensed at a temperature significantly lower than that of conventional drink dispensers.

In the preferred embodiment, product conduits 26A–F and carbonated water conduit 27 may be constructed of any conventional metal or copper tubing, however, one of ordinary skill in the art will readily recognize that such tubing could be encased within aluminum or the conduits themselves comprised of aluminum tubing in order to enhance the heat exchange between the product conduits and the carbonated water conduit.

Referring to FIGS. 6 and 7, the configuration and operation of the beverage dispensing apparatus according to the preferred embodiment of the present invention will be described. Because modular dispensing tower 10 will function to dispense drinks although connected remotely from the remaining beverage dispensing apparatus, that apparatus may be placed in an out of the way location such as underneath a counter. The remaining beverage dispensing apparatus comprises cooling unit 30, $CO_2$ source 31, product source 32, and trunk line 33. Cooling unit 30 comprises a water bath used to cool water before it is carbonated, the carbonated water itself, and the product. The water bath comprises a cooling chamber filled with a cooling fluid, typically water, with a refrigeration unit positioned over the cooling chamber such that its evaporator coils are immersed in the water, thereby, facilitating the forming of an ice bank within the cooling chamber. Residing in the center of the cooling chamber and, thus, inside the ice bank is a water line which is connected at its inlet to a water source and its outlet to a carbonator which resides in the front portion of the cooling chamber. Also residing within the front portion of the cooling chamber are product coils which communicate at their inlets to product source 32 and at their outlets with product conduits 26A–F via trunk line 33 (described herein). The carbonator also communicates at an inlet with $CO_2$ source 31 so that the carbonator may form carbonated water from the water and $CO_2$. Residing behind the product coils is a recirculation coil which connects along with the carbonator to the inlet of carbonated water conduit 27 via trunk line 33. A T-shaped connection allows both the carbonator and the outlet of the recirculation coil to be connected to carbonated water conduit 27. The inlet of the recirculation coil also connects to the outlet of carbonated water conduit 27 via trunk line 33. The ice bank formed by the refrigeration unit serves to exchange heat between the water carried in the water line, the product carried in the product coils and the recirculated carbonated water contained in the recirculation coil.

Thus, in operation, modular dispensing tower 10 is first connected to the product coils, carbonator, and recirculation coil utilizing trunk line 33. Trunk line 33 is an insulated tube which has a plurality of conduits running through it. In the configuration of FIG. 6, trunk line 33 is placed through a hole (not shown) in the countertop and connected to modular dispensing tower 10. Each of product conduits 26A–F and the inlet and outlet of carbonated water conduit 27 is connected to an individual conduit housed within trunk 33 (in the preferred embodiment it is twenty-five feet ) . Connection between the conduits is made by forcing the conduits contained within trunk line 33 over the barbs at the end of the conduits housed within manifold 14, crimping the trunk conduits down, and securing them using a clamp. The correct and corresponding trunk conduit is then connected to one side of the T-connection between the outlet of the recirculation coil and the carbonator, the inlet of the recirculation coil, and the product lines using the exact same procedure as above. In the above configuration, back cover 12 is connected to housing 11 for aesthetic purposes, and modular dispensing tower 10 merely resides on top of the counter.

Figure 2:
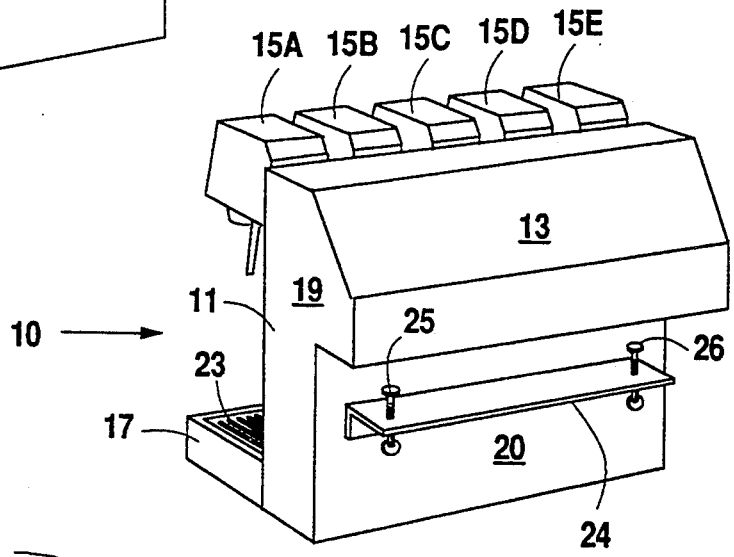
FIG. 2 is a perspective view showing the rear of the modular dispensing tower of the present invention in the configuration used when it is mounted onto the end of a planar surface.

In the configuration shown in FIG. 7, modular dispensing tower 10 is connected to the edge of the counter using bracket 24 described above in reference to FIG. 2. Modular dispensing tower 10 is positioned on the edge of the counter such that the counter edge abuts back wall 20, and the portion of housing 11 which extends over back wall 20 resides upon the top of the counter. Fastening screws 25 and 26 are then tighten firmly against the bottom of the counter, thereby, securing modular dispensing tower 10 to the front of the counter. In this configuration, trunk line 33 is connected to modular dispensing tower 10 exactly the same, except that it is positioned in front of the countertop.

In operation, product from product source 32 is pumped through the product coils residing within the water bath to cool the product before it is pumped to dispensing valves 15A–E where it is dispensed upon demand. Water is pumped from the water source through the water lines where it is initially cooled before entering the carbonator. Additionally, $CO_2$ is delivered under pressure from $CO_2$ source 31 to the carbonator. The carbonator places the $CO_2$ in solution to form carbonated water which is then pumped to dispensing valves 15A–E where it is also dispensed with the product on demand. However, during periods of low use, carbonated water is not pumped from the carbonator, and the carbonated water already in the carbonated water lines is pumped continuously through carbonated water conduit 27 to the recirculation coil and then back the carbonated water conduit 27 via its connection by trunk line 33. Thus, the carbonated water continuously exchanges heat with the ice bank such that when it is pumped back to carbonated water conduit 27 it is extremely cold and, therefore, exchanges heat with the product just sitting within product conduits 26A–F. During period of peak use, however, the carbonator will pump sufficient carbonated water to carbonated water conduit 27 to ensure proper carbonated water to product ratio.

The present invention, therefore, is configured to largely reside in an out of the way place such as under a counter while still dispensing cold drinks. Additionally, the modular dispensing tower by comprising an insulated manifold which allows constant heat exchange in a recirculation system produces drinks, especially the "casual" drink at a temperature far below that of conventional dispensers. Specifically, the present invention will dispense a "casual" drink at or below a temperature of 38° F.

From the foregoing description and illustration of this invention, it is apparent that various modifications can be made by reconfigurations or combinations to produce similar results. It is, therefore, the desire of the Applicant not to be bound by the description of this invention as contained in this specification, but to be bound only by the claims as appended hereto.

I claim:

1. A modular dispensing tower, comprising:

a housing;

dispensing means mounted on said housing;

a plurality of product conduits each having an inlet thereto and an outlet therefrom which communicates with said dispensing means;

a mixing fluid conduit having an inlet thereto, an outlet therefrom to allow the circulation of said mixing fluid, and a plurality of outlets communicating with said dispensing means, wherein said mixing fluid conduit contacts each of said plurality of product conduits to produce heat exchange directly therebetween; and a manifold disposed in said housing, said manifold comprising an insulating material which encapsulates said plurality of product conduits and said mixing fluid conduits.

2. The modular dispensing tower according to claim 1 wherein said housing comprises side walls formed integrally with front and rear walls and a top cover.

3. The modular dispensing tower according to claim 2 wherein said housing further comprises a bracket connected to said rear wall for mounting said housing onto a planar surface.

4. The modular dispensing tower according to claim 3 wherein said housing further comprises a back cover mountable to said rear wall and over said bracket.

5. The modular dispensing tower according to claim 4 wherein said housing further comprises a drip tray, having a cup rest, mounted onto said front wall.

6. The modular dispensing tower according to claim 1 wherein said dispensing means comprises dispensing valves.

7. A beverage dispensing apparatus, comprising:

a product source and a mixing fluid source;

cooling means in fluid communication with said product source and said mixing fluid source to cool said product and said mixing fluids; and a dispensing tower positioned remote from and in fluid communication with said cooling means to dispense said product and said mixing fluid, said dispensing tower comprising;

a housing;

dispensing means mounted on said housing;

a plurality of product conduits each having an inlet communicating with said cooling means and an outlet communicating with said dispensing means, a mixing fluid conduit having an inlet communicating with said cooling means, an outlet communicating with said cooling means to allow the circulation of said mixing fluid, and a plurality of outlets communicating with said dispensing means, wherein said mixing fluid conduit contacts each of said plurality of product conduits to produce heat exchange directly therebetween, and a manifold disposed in said housing, said manifold comprising an insulating material which encapsulates said plurality of product conduits and said mixing fluid conduits.

8. The beverage dispensing apparatus according to claim 7 wherein said cooling means includes a mixing fluid recirculation means.

9. The beverage dispensing apparatus according to claim 7 wherein said plurality of product conduits and said mixing fluid conduit of said manifold fluidly communicate with said cooling means utilizing a plurality of conduits housed within an insulated trunk line.

10. The beverage dispensing apparatus according to claim 9 wherein said mixing fluid conduit of said manifold fluidly communicates with said mixing fluid recirculation means.

11. The beverage dispensing apparatus according to claim 7 wherein said housing of said dispensing tower comprises side walls formed integrally with front and rear walls and a top cover.

12. The beverage dispensing apparatus according to claim 11 wherein said housing of said dispensing tower further comprises a bracket connected to said rear wall for mounting said housing onto a planar surface.

13. The beverage dispensing apparatus according to claim 12 wherein said housing of said dispensing tower further comprises a back cover mountable to said rear wall and over said bracket.

14. The beverage dispensing apparatus according to claim 13 wherein said housing of said dispensing tower further comprises a drip tray, having a cup rest, mounted onto said front wall of said housing.

15. The beverage dispensing apparatus according to claim 7 wherein said dispensing means of said dispensing tower comprises dispensing valves.

* * * * *